US009162840B1

(12) United States Patent
Ohta

(10) Patent No.: US 9,162,840 B1
(45) Date of Patent: Oct. 20, 2015

(54) SHEET CONVEYING DEVICE

(71) Applicant: BROTHER KOGYO KABUSHIKI KAISHA, Nagoya-shi, Aichi-ken (JP)

(72) Inventor: Masahiko Ohta, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/668,470

(22) Filed: Mar. 25, 2015

(30) Foreign Application Priority Data

Mar. 31, 2014 (JP) ..... 2014-071986

(51) Int. Cl.

| | |
|---|---|
| ***B65H 29/22*** | (2006.01) |
| ***B65H 31/34*** | (2006.01) |
| ***B65H 31/26*** | (2006.01) |
| ***B65H 29/70*** | (2006.01) |

(52) U.S. Cl.
CPC ..... *B65H 29/22* (2013.01); *B65H 29/70* (2013.01); *B65H 31/26* (2013.01); *B65H 31/34* (2013.01)

(58) Field of Classification Search
CPC ..... B65H 29/22; B65H 31/26; B65H 31/34; B65H 31/36; B65H 29/12; B65H 29/70
USPC ..... 271/220
See application file for complete search history.

(56) References Cited

U.S. PATENT DOCUMENTS

| | | | | |
|---|---|---|---|---|
| 6,279,899 | B1 * | 8/2001 | Coffey et al. | 271/220 |
| 6,550,763 | B2 * | 4/2003 | Gordon et al. | 271/189 |
| 9,016,681 | B2 * | 4/2015 | Mizubata et al. | 270/58.11 |
| 2002/0101029 | A1 * | 8/2002 | Ardery et al. | 271/207 |
| 2002/0195767 | A1 * | 12/2002 | Mlejnek et al. | 271/207 |
| 2006/0181018 | A1 * | 8/2006 | Van Soest | 271/314 |
| 2010/0150634 | A1 | 6/2010 | Yoshida | |

FOREIGN PATENT DOCUMENTS

| | | | |
|---|---|---|---|
| JP | H07277581 | A | 10/1995 |
| JP | 2005239424 | A | 9/2005 |
| JP | 2010143647 | A | 7/2010 |

* cited by examiner

*Primary Examiner* — Jeremy R Severson
(74) *Attorney, Agent, or Firm* — Merchant & Gould PC

(57) ABSTRACT

A sheet conveying device includes: a conveyor; a stacking surface configured to support a sheet to be discharged by a discharge roller, and a movable member, which is provided downstream from the discharge roller in the discharge direction, is supported so as to be swingable on a swinging shaft, wherein the movable member has a first surface and a second surface, wherein the first surface is inclined at a first inclined angle relative to the stacking surface so that the first guide surface is inclined towards the stacking surface, wherein the second surface is inclined at a second inclined angle relative to the stacking surface so that the second surface is inclined towards the stacking surface, and wherein the second inclined angle is smaller than the first inclined angle.

13 Claims, 10 Drawing Sheets

SHEET CONVEYING DEVICE

CROSS-REFERENCE TO RELATED APPLICATION

This application claims priority from Japanese Patent Application No. 2014-071986 filed on Mar. 31, 2014, the entire subject matter of which is incorporated herein by reference.

TECHNICAL FIELD

This disclosure relates to a sheet conveying device.

BACKGROUND

Conventionally, there is known a sheet conveying device. The sheet conveying device includes a conveyor, a stacking surface, a first guide member and a second guide member.

The conveyor is configured to convey a sheet along a predetermined conveyance path and to discharge the same in a discharge direction by a discharge roller. The stacking surface is configured to support the sheet discharged by the discharge roller. The first guide member and the second guide member are provided at a downstream side corresponding the discharge roller in the discharge direction. The first guide member and the second guide member are separate members. The second guide member is at an inner position relative to the first guide member in a width direction of the stacking surface. The first guide member and the second guide member are swingably supported around a swinging shaft center parallel with the width direction of the staking surface.

The first guide member and the second guide member are configured to guide the discharged sheet toward the stacking surface. Specifically, when a size of the discharged sheet is so small that it may not be guided by the first guide member, the second guide member guides the small size sheet toward the stacking surface. In this way, the sheet conveying device orderly stacks the sheets on the stacking surface when discharging the sheets having different sizes.

However, according to the sheet conveying device of the related art, since the first guide member and the second guide member are separate members, the number of components is increased and a mounting operation may be thus troublesome. As a result, it is difficult to save the manufacturing cost of the sheet conveying device.

SUMMARY

This disclosure is to provide a sheet conveying device capable of orderly stacking sheets on a stacking surface when discharging the sheets having different sizes, while saving the manufacturing cost thereof.

A sheet conveying device includes: a conveyor configured to: convey a sheet along a predetermined conveyance path; and discharge the sheet in a discharge direction by a discharge roller; a stacking surface configured to support the sheet discharged by the discharge roller; and a movable member provided downstream from the discharge roller in the discharge direction and supported so as to be swingable on a swinging shaft extending parallel with a width direction of the stacking surface, wherein the movable member has a first surface and a second surface that is positioned closer to a center of the stacking surface in the width direction than the first surface, wherein the first surface is inclined at a first inclined angle relative to the stacking surface so that the first surface is inclined towards the stacking surface in the discharge direction, wherein the second guide surface is inclined at a second inclined angle relative to the stacking surface so that the second surface is inclined towards the stacking surface in the discharge direction, and wherein the second inclined angle is smaller than the first inclined angle.

According to the sheet conveying device of this disclosure, while it is possible to save the manufacturing cost, it is possible to orderly stack the sheets on the stacking surface when discharging the sheets having different sizes on the stacking surface.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Hereinafter, first and second illustrative embodiments of this disclosure will be described with reference to the drawings.

First Illustrative Embodiment

Figure 1:
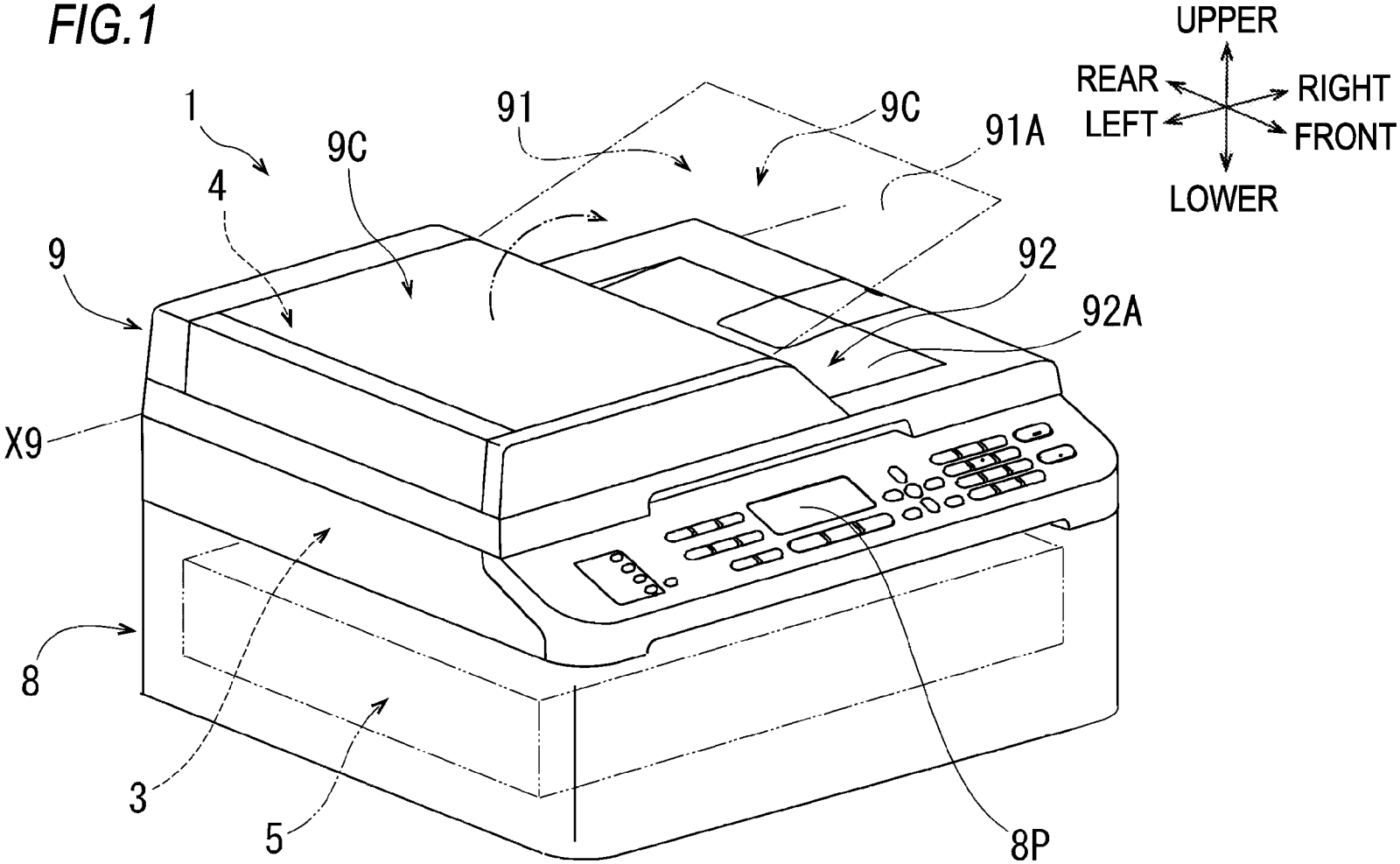
FIG. 1 is a perspective view of an image reading apparatus of a first illustrative embodiment.

As shown in FIG. 1, an image reading apparatus 1 of an illustrative embodiment is an example of a specific aspect of the sheet conveying device of this disclosure. In FIG. 1, a side at which an operation panel 8P is defined as a front side of the apparatus and a left side on the basis of the operation panel 8P is defined as a left side, so that respective directions of front, rear, left, right, upper and lower are indicated. The respective directions denoted in FIG. 2 and thereafter are indicated in correspondence to the respective directions denoted in FIG. 1.

Hereinafter, the respective elements of the image reading apparatus 1 will be described on the basis of FIG. 1 and the like.

<Overall Configurations>

As shown in FIG. 1, the image reading apparatus 1 includes a main body unit 8, an opening/closing unit 9, an image forming unit 5, a reading unit 3, a feeder tray 91, a discharge tray 92 and a conveyor 4. The main body unit 8 is a substantially flat box-shaped member. As shown in FIG. 1, a front surface of the main body unit 8 is provided with the operation panel 8P such as a touch panel.

Figure 4:
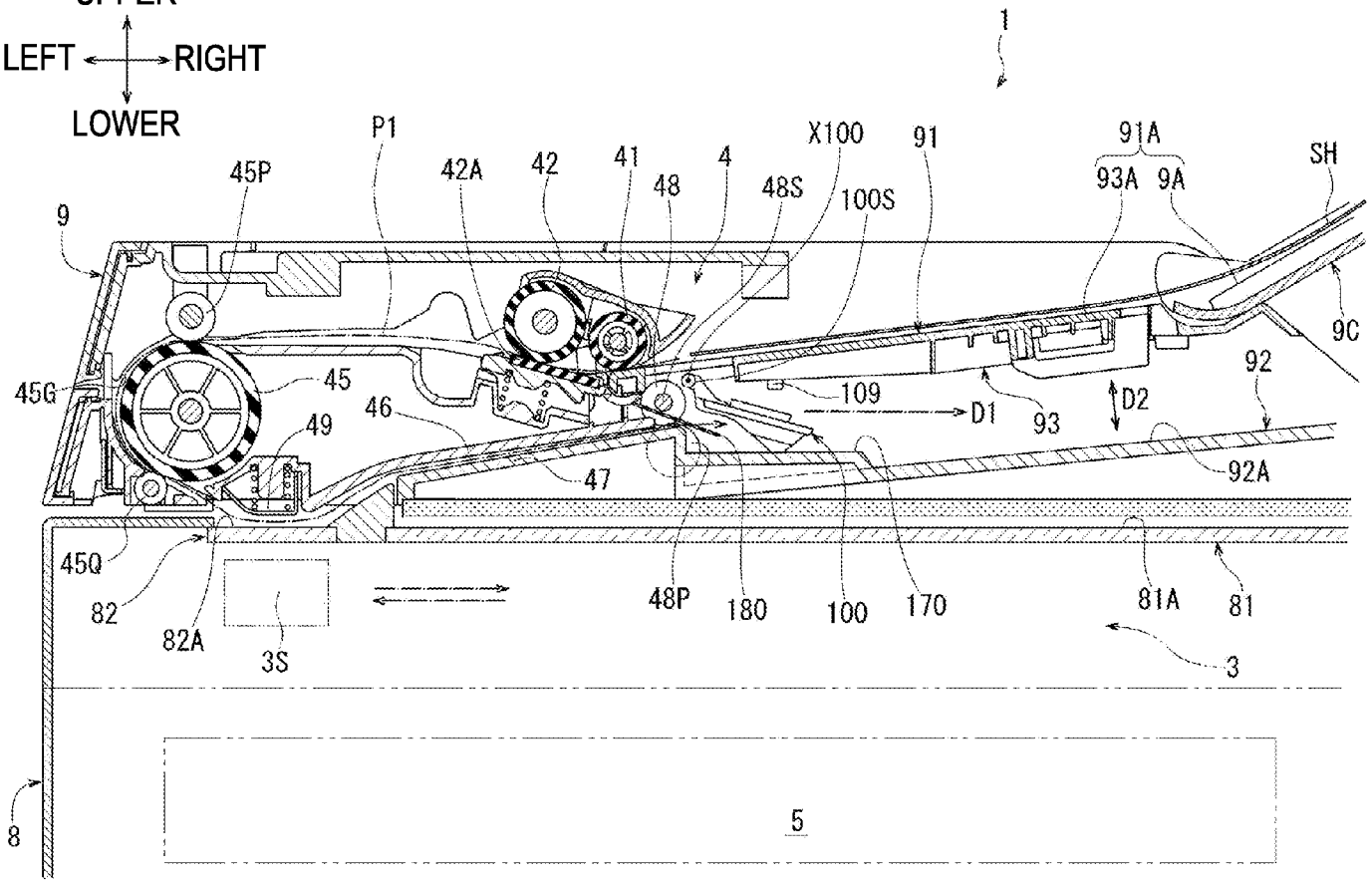
FIG. 4 is a partial sectional view taken along a line A-A of FIG. 2.

As shown in FIGS. 1 and 4, the image forming unit 5 is accommodated at a lower part in the main body unit 8. The image forming unit 5 is configured to form an image on a sheet by an inkjet or laser scheme. The reading unit 3 is positioned at an upper part in the main body unit 8. The reading unit 3 is used when reading an image of a document.

As shown in FIG. 4, a first platen glass 81 and a second platen glass 82 are arranged on an upper surface of the main body unit 8. An upper surface of the first platen glass 81 configures a document support surface 81A. The document support surface 81A supports a stationary document from below when the reading unit 3 reads an image of the document. The document to be read includes a sheet such as an OHP sheet, a book and the like. The second platen glass 82 is positioned at the left of the first platen glass 81 and is elongated in the front-rear direction. An upper surface of the second platen glass 82 configures a reading surface 82A. When the reading unit 3 reads an image of the sheet SH being conveyed one by one by the conveyor 4, the reading surface 82A guides the sheet SH from below.

As shown in FIG. 1, the opening/closing unit 9 is swingably supported around an opening/closing shaft center X9 extending in the left-right direction by hinges (not shown) arranged at a rear-side upper portion of the main body unit 8. The opening/closing unit 9 is movable between an open position and a closed position. At the closed position shown in FIGS. 1 to 4, the opening/closing unit 9 is configured to cover the document support surface 81A from above. Although not shown, the opening/closing unit 9 is rotated around the opening/closing shaft center X9 so that a front end portion-side thereof is displaced upward and rearward. Thereby, the opening/closing unit 9 is displaced to the opened position at which the document support surface 81A is exposed. Thereby, a user can make the document support surface 81A support a document which is a read target.

As shown in FIG. 4, the reading unit 3 includes a reading sensor 3S accommodated at an upper part in the main body unit 8 and a scanning mechanism (not shown). The reading sensor 3S is an example of the 'reading unit' of this disclosure. The scanning mechanism is configured to reciprocally move the reading sensor 3S in the left-right direction below the document support surface 81A and the reading surface 82A. As the reading sensor 3S, a well-known image reading sensor such as a CIS (Contact Image Sensor) and a CCD (Charge Coupled Device) is used.

The conveyor 4 is provided at the opening/closing unit 9. The conveyor 4 includes the feeder tray 91 and the discharge tray 92. The feeder tray 91 is formed at a right part of the opening/closing unit 9 by opining a closed cover 9C shown with a solid line in FIG. 1, as shown with a dashed-two dotted line in FIG. 1.

Figure 2:
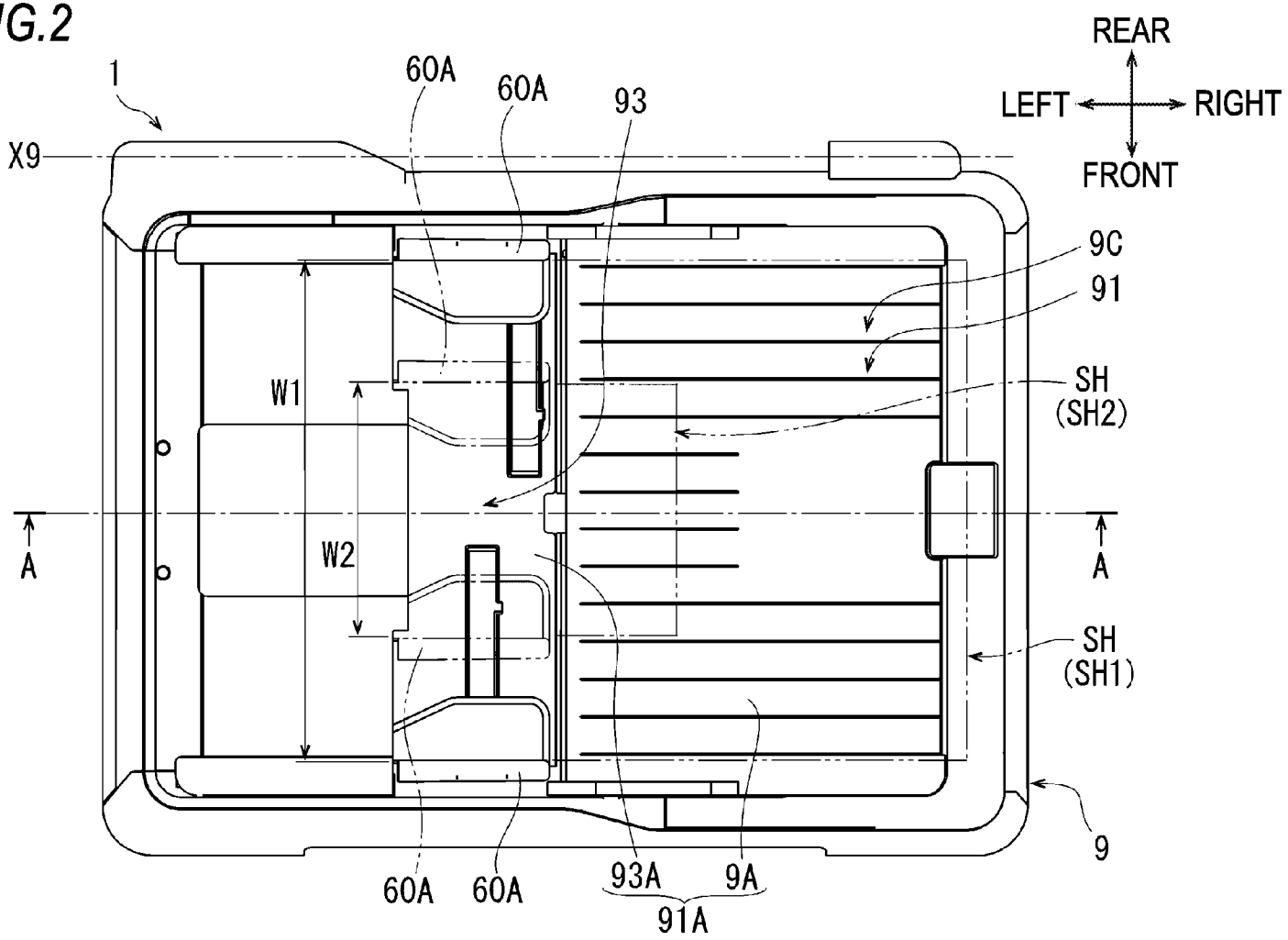
FIG. 2 is a plan view of the image reading apparatus of the first illustrative embodiment.
Figure 3:
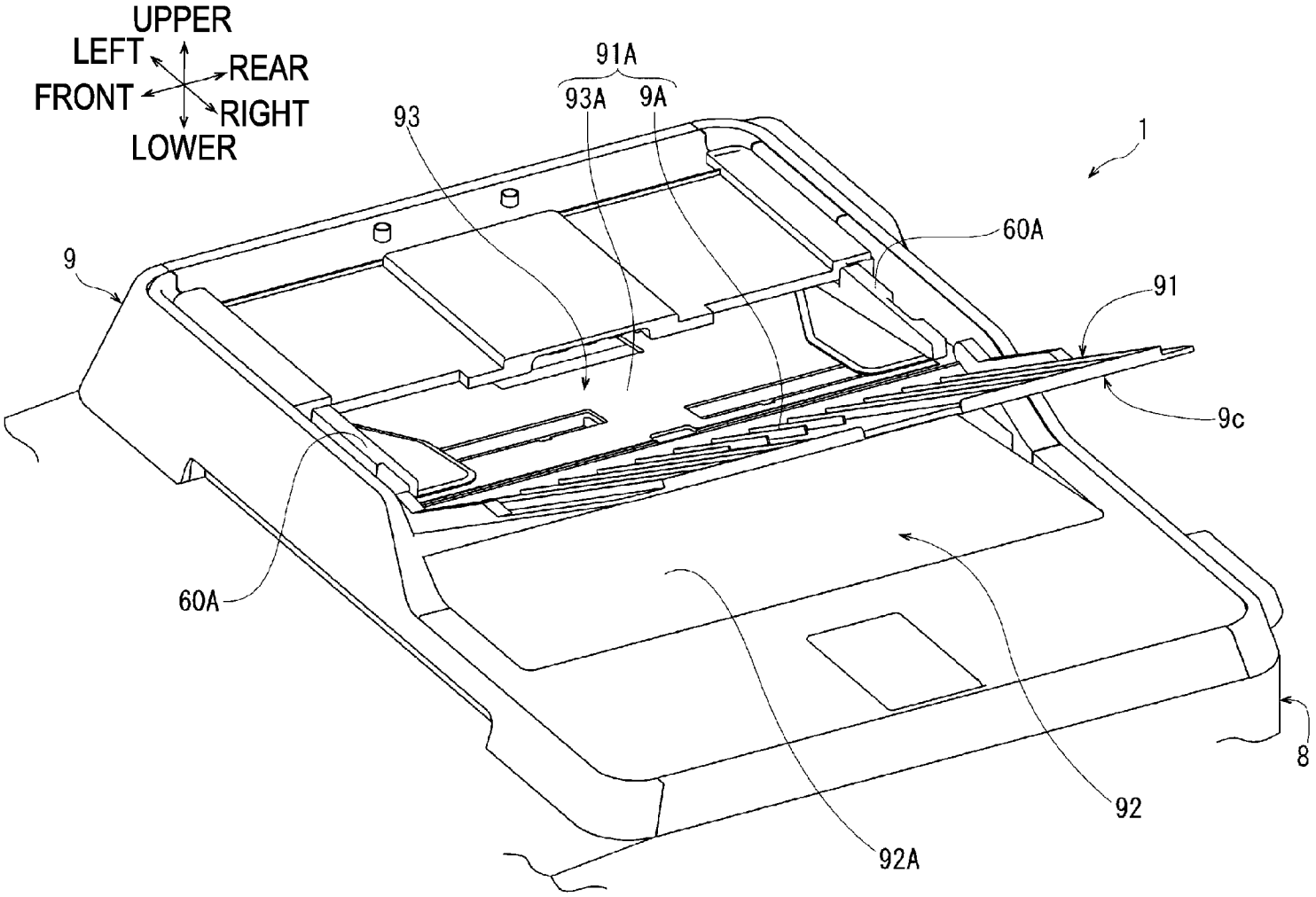
FIG. 3 is a partial perspective view of the image reading apparatus of the first illustrative embodiment.

Also, as shown in FIGS. 2 to 4, the feeder tray 91 is formed by the spread cover 9C and a chute member 93 positioned downstream with respect to the cover 9C in a conveying direction. An upper surface of the cover 9C configures a part of a sheet support surface 91A. The sheet support surface 91A is configured to support a plurality of sheets SH, which are to be conveyed by the conveyor 4 and are reading targets, from below at a stacked state. The sheet support surface 91A is formed by a first sheet support surface 9A, which is an upwardly facing surface of the spread cover 9C, and a second sheet support surface 93A, which is a right part of an upper surface of the chute member 93. The sheet support surface 91A is a flat surface inclined leftward and downward.

As shown in FIGS. 2 and 3, the second sheet support surface 93A of the feeder tray 91 is provided with a pair of guides 60A, 60A configured to be slidable in the front-rear direction. The pair of guides 60A, 60A faces each other in the front-rear direction. The pair of guides 60A, 60A is coupled by a rack-and-pinion mechanism (not shown). As shown with a solid line and a dashed-two dotted line in FIG. 2, the pair of guides 60A, 60A is enabled to come close to and to separate from each other, thereby sandwiching a plurality of types of sheets SH having different sizes, which are supported on the sheet support surface 91A of the feeder tray 91, in the front-rear direction. In this way, the pair of guides 60A, 60A is configured to position the sheet SH on the feeder tray 91 on the basis of a center of the sheet support surface 91A in the front-rear direction.

As shown in FIG. 2, in this illustrative embodiment, the sheet SH having a maximum size that can be conveyed by the conveyor 4 is a letter-size sheet SH1, for example. The letter-size sheet SH1 is defined as a first size sheet. When positioning the first size sheet SH1 on the feeder tray 91, the pair of guides 60A, 60A shown with the solid line in FIG. 2 is spaced at the same interval as a length W1 of the first size sheet SH1 in the front-rear direction, thereby sandwiching the sheet SH1 in the front-rear direction.

Also, in this illustrative embodiment, there is an A6 size sheet of the sheets SH, which can be conveyed by the conveyor 4, as a sheet having a size smaller than the first size sheet SH1. The A6 size sheet SH2, for example, is defined as a second size sheet. When positioning the second size sheet SH2 on the feeder tray 91, the pair of guides 60A, 60A shown with the dashed-two dotted line in FIG. 2 is spaced at the same interval as a length W2 of the second size sheet SH2 in the front-rear direction, thereby sandwiching the sheet SH2 in the front-rear direction.

Although not shown, when positioning the sheet SH having a size between the first size sheet SH1 and the second size sheet SH2 on the feeder tray 91, the pair of guides 60A, 60A is spaced at the same interval as a length of the sheet SH in the front-rear direction, thereby sandwiching the sheet SH in the front-rear direction. Also, the conveyor 4 can convey a postcard slightly smaller than the A6 size sheet. The pair of guides 60A, 60A is spaced at the same interval as a length of the postcard in the front-rear direction, thereby sandwiching the postcard in the front-rear direction.

As shown in FIGS. 3 to 6, the discharge tray 92 is positioned below the feeder tray 91 and is arranged to overlap vertically with the same. An upper surface of the discharge tray 92 is configured as a stacking surface 92A. The sheet SH of which an image has been read by the reading sensor 3S and has been discharged by the conveyor 4 is stacked on the stacking surface 92A of the discharge tray 92.

As shown in FIG. 4, the conveyor 4 defines a conveyance path P1, as a space surrounded by guide surfaces extending to be able to abut on one surface and the other surface of the sheet SH, conveying rollers (which will be described later) and the like. The conveyance path P1 includes a part extending substantially horizontally leftward from a downstream end portion of the sheet support surface 91A of the feeder tray 91 in the conveying direction. Then, the conveyance path P1 includes a downwardly curved part. Then, the conveyance path P1 includes a part extending shortly rightward along the reading surface 82A. Finally, the conveyance path P1 includes a part inclined rightward and upward from a downstream side of the reading surface 82A in the conveying direction and reaching the discharge tray 92.

A conveying direction of the sheet SH that is conveyed by the conveyor 4 is a leftward direction on a substantially horizontal upper part of the conveyance path P1, is switched from the leftward direction to a rightward direction on the downwardly curved part of the conveyance path P1 and is a rightward direction on the lower part of the conveyance path P1 passing through the reading surface 82A and reaching the discharge tray 92. The extending directions and shapes of the conveyance path P1 are just exemplary.

The conveyor 4 includes a supply roller 41, a separation roller 42 and a separation pad 42A at positions of the conveyance path P1 close to the feeder tray 91. The supply roller 41 is configured to deliver the sheet SH supported on the sheet support surface 91A of the feeder tray 91 towards the downstream-side separation roller 42. When a plurality of sheets SH is conveyed with overlapping with each other, the separation roller 42 separates the sheets one by one in cooperation with the separation pad 42A and conveys the same towards a further downstream side in the conveying direction.

The conveyor 4 includes a large diameter conveying roller 45, a curved guide surface 45G and pinch rollers 45P, 45Q at the downwardly curved part of the conveyance path P1. An outer peripheral surface of the conveying roller 45 is configured to form an inner guide surface of the downwardly curved part of the conveyance path P1. The curved guide surface 45G is arranged at a predetermined interval from the outer peripheral surface of the conveying roller 45. The curved guide surface 45G is configured to form an outer guide surface of the downwardly curved part of the conveyance path P1. The conveying roller 45 is configured to convey the sheet SH towards the reading surface 82A in cooperation with the pinch rollers 45P, 45Q abutting on the outer peripheral surface of the conveying roller 45.

The conveyor 4 includes a pressing member 49 at a position facing the reading surface 82A, from above. The pressing member 49 is configured to press the sheet SH, which is being conveyed from the conveying roller 45, from above, thereby causing the sheet SH into contact with the reading surface 82A.

The conveyor 4 includes guide walls 47, 46 at the right of the pressing member 49. The guide wall 47 defines an upwardly inclined part of the conveyance path P1 at the right of the pressing member 49, from below. The guide wall 46 is positioned above the guide wall 47 and is configured to form a gap between the guide wall 46 and the guide wall 47. The guide walls 47, 46 extend in right-left direction. The guide wall 46 defines an upwardly inclined part of the conveyance path P1 at the right of the pressing member 49, from above.

Figure 5:
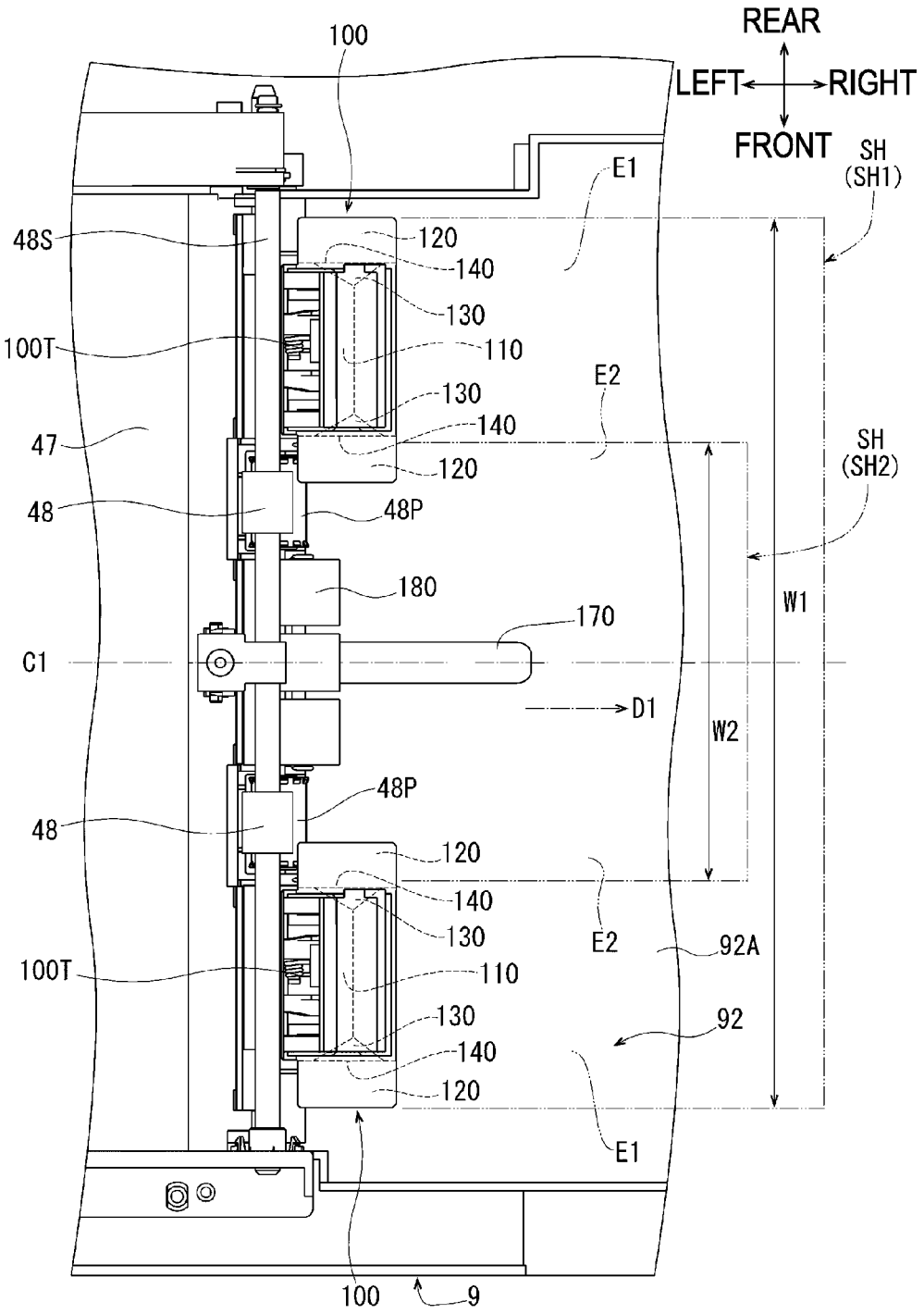
FIG. 5 is a partial plan view illustrating discharge rollers, discharge pinch rollers, a stacking surface, a pair of guide members, a protrusion and a pressing member.
Figure 6:
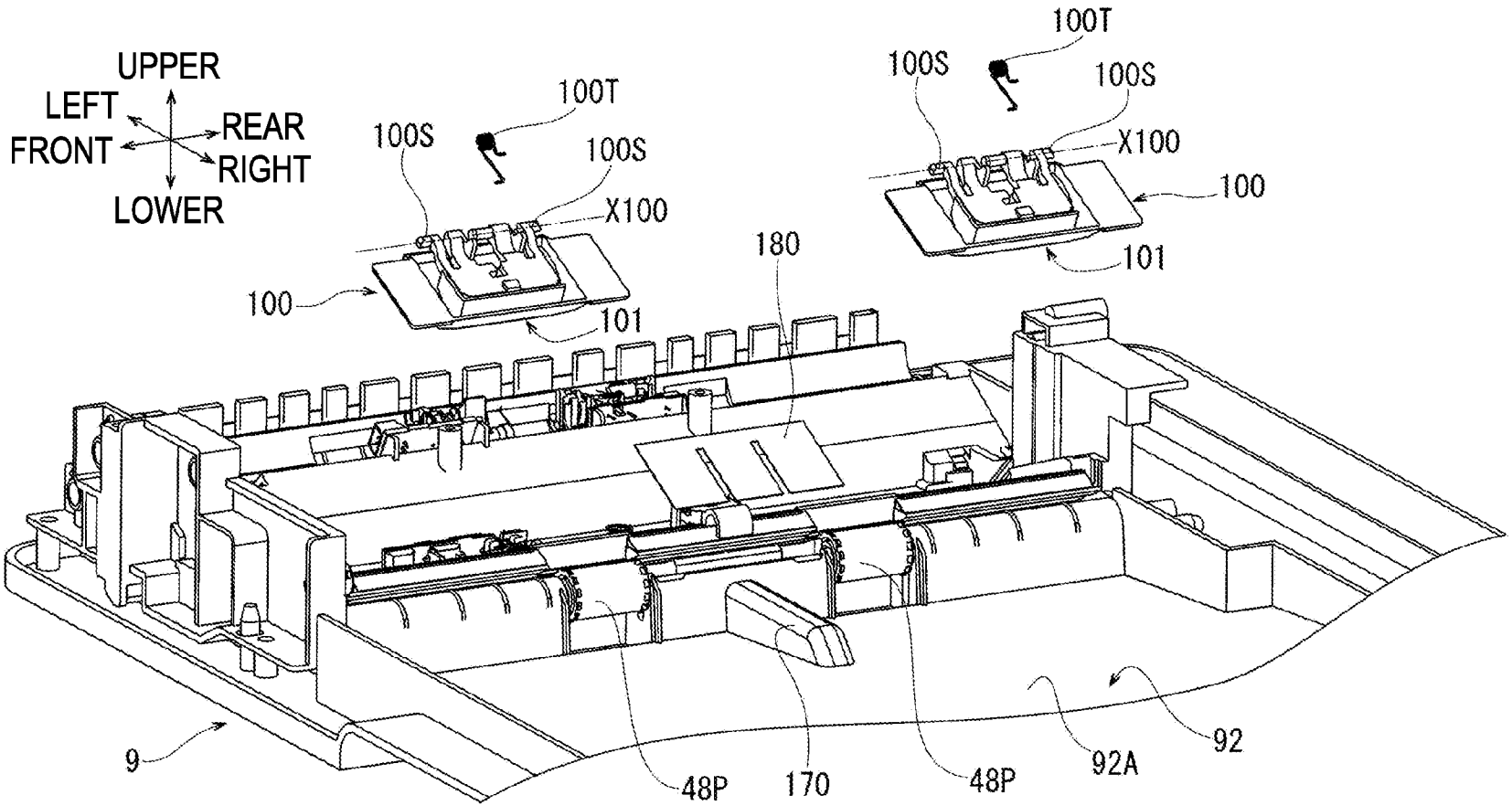
FIG. 6 is an exploded perspective view illustrating the discharge pinch rollers, the stacking surface, the guide members, the protrusion and the pressing member.

As shown in FIGS. 4 to 6, the conveyor 4 includes discharge rollers 48 and pinch rollers 48P at the right side of the pressing member 49 in the upwardly inclined part of the conveyance path P1. The discharge rollers 48 and the pinch rollers 48P face towards the discharge tray 92. The discharge rollers 48 are positioned at a right end portion of the guide wall 46. The pinch rollers 48P are positioned at a right end portion of the guide wall 47.

As shown in FIGS. 5, 9 and 10, the two discharge rollers 48 are attached at front and rear sides with respect to a center of a driving shaft 48S extending in the front-rear direction. Each of the discharge rollers 48 is rotated by the driving shaft 48S. The two pinch rollers 48P are pressed to the corresponding discharge rollers 48. The discharge rollers 48 and the pinch rollers 48P are configured to nip the sheet SH having passed above the reading surface 82A respectively, thereby discharging the sheet SH onto the stacking surface 92A of the discharge tray 92. A discharge direction D1 indicates a direction in which the sheet SH is discharged onto the stacking surface 92A of the discharge tray 92.

<Image Reading Operation>

According to the image reading apparatus 1, when reading an image of a document supported on the document support surface 81A, the scanning mechanism (not shown) of the reading unit 3 is operated to move the reading sensor 3S in the left-right direction between left end portion of the document support surface 81A and right end portion thereof. Thereby, the reading sensor 3S reads the image of the document supported on the document support surface 81A. Thereafter, the scanning mechanism (not shown) returns the reading sensor 3S having completed the reading to the original position by moving the same from the right end portion to the left end portion in the reading unit 3.

Also, according to the image reading apparatus 1, when reading an image of the sheet SH on the feeder tray 91, the scanning mechanism (not shown) of the reading unit 3 is operated to stop the reading sensor 3S at a predetermined reading position. The predetermined reading position of the reading sensor 3S is below the reading surface 82A. The reading sensor 3S located at the predetermined reading position is positioned upstream from the discharge rollers 48 in the discharge direction D1. When the conveyor 4 sequentially conveys the sheets SH on the feeder tray 91 along the conveyance path P1, the sheet SH passes above the reading sensor 3S located at the predetermined reading position with contacting the reading surface 82A. Therefore, the reading sensor 3S reads an image of the passing sheet SH. Then, the sheet SH of which an image has been read is discharged to the discharge tray 92 by the discharge rollers 48 and pinch rollers 48P. The discharged sheet SH is supported from below by the stacking surface 92A of the discharge tray 92.

<Configurations of Protrusion, Pair of Guide Members and Pressing Member>

As shown in FIGS. 4 to 10A, the image reading apparatus 1 has a protrusion 170, a pair of guide members 100, 100 (one example of the movable member) and a pressing member 180.

As shown in FIGS. 4 to 6, the protrusion 170 is formed integrally with the discharge tray 92. The protrusion 170 is provided at a central portion of the stacking surface 92A in the width direction. A part of the protrusion 170 is overlapped with the guide member 100, in a horizontal view.

In this illustrative embodiment, the width direction of the stacking surface 92A is the front-rear direction. As shown in FIG. 5, the central portion of the stacking surface 92A in the width direction is a position indicated by a central line C1 of the stacking surface 92A extending in the left-right direction. The central line C1 passes through a central point of the length W1 of the first size sheet SH1 in the front-rear direction, which is to be discharged to the discharge tray 92, and a central point of the length W2 of the second size sheet SH2 in the front-rear direction, which is to be discharged to the discharge tray 92. That is, the sheet SH1 conveyed by the conveyor 4 and discharged to the discharge tray 92 is stacked on the stacking surface 92A on the basis of the center.

Figure 8:
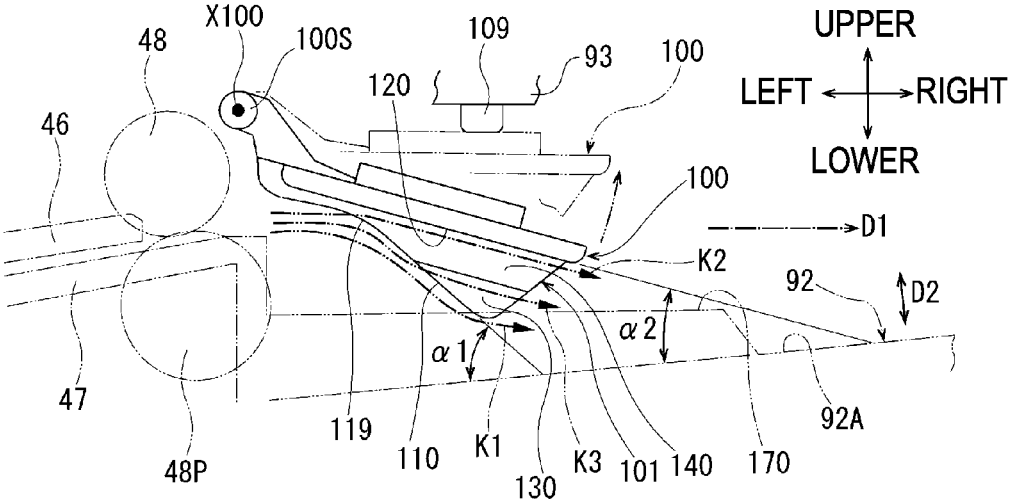
FIG. 8 is a schematic partial side view illustrating relative relations of the discharge roller, the discharge pinch roller, the stacking surface, the guide member, the protrusion and a stopper.

As shown in FIGS. 4 and 8, the protrusion 170 protrudes upwardly in a direction D2 orthogonal to the stacking surface 92A and extends rightward from a vicinity of the discharge roller 48, i.e., in the discharge direction D1. The direction D2 orthogonal to the stacking surface 92A is slightly inclined with respect to the upper-lower direction. An upper end surface of the protrusion 170 is configured to be closer to the stacking surface 92A as it proceeds rightward. In other words, the upper end surface of the protrusion 170 extends horizontally and the stacking surface 92A is inclined to be gradually higher as it proceeds a right end. As a result, the upper end surface of the protrusion 170 has a shape coming close to the stacking surface 92A.

In this illustrative embodiment, an inner part of the stacking surface 92A in the width direction is a part close to the protrusion 170 in the front-rear direction. An outer part of the stacking surface 92A in the width direction is a part distant from the protrusion 170 in the front-rear direction. One direction of the stacking surface 92A in the width direction is a direction toward front with respect to the protrusion 170. The other direction of the stacking surface 92A in the width direction is a direction toward rear with respect to the protrusion 170.

As shown in FIGS. 4 and 8, the pair of guide members 100, 100 is provided at the right of the discharge rollers 48, i.e., downstream from the discharge rollers 48 in the discharge direction D1. The pair of guide members 100, 100 are scarcely overlapped with the discharge rollers 48 as viewed in the left-right direction As shown in FIGS. 5 and 6, the respective guide members 100, 100 are provided at the front of the protrusion 170 and at the rear of the protrusion 170, respectively.

Each of the guide members 100, 100 is an injection-molded product of a thermoplastic resin. The front guide member 100 and the rear guide member 100 are the same components. That is, according to the image reading apparatus 1, the components are commonly used for the front guide member 100 and the rear guide member 100, so that it is possible to save the manufacturing cost.

Figure 7:
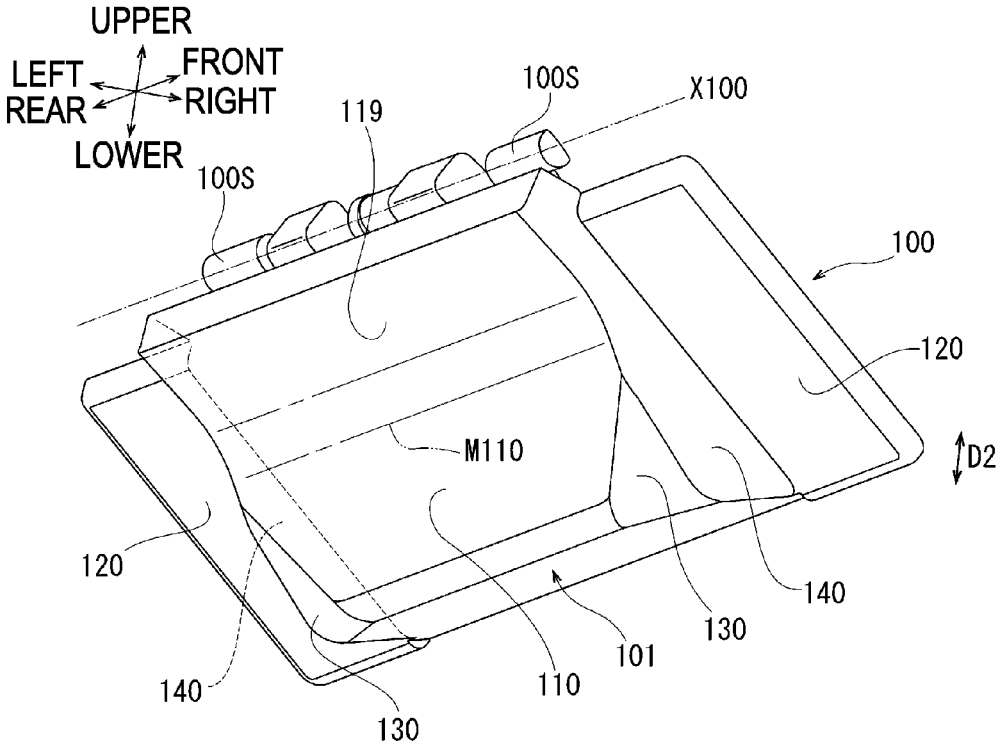
FIG. 7 is a perspective view of the guide member.

As shown in FIGS. 6 and 7, a left end portion of the guide member 100 is protrudely formed with a shaft part 100S extending in parallel with the front-rear direction, which is the width direction of the stacking surface 92A. The shaft part 100S is supported to an internal frame (not shown) in the opening/closing unit 9, so that each of the guide members 100, 100 may swing around a swinging shaft center X100 extending in parallel with the front-rear direction, which is the width direction of the stacking surface 92A. As shown in FIGS. 4 and 8, the swinging shaft center X100 is positioned at a right-upper side of the discharge roller 48.

As shown in FIG. 5, the guide member 100 has a rectangular shape that is long in the front-rear direction, in the top view. As shown in FIG. 7, the guide member 100 is formed with a bulging part 101 bulging downwardly at a central portion thereof in the front-rear direction.

As shown in FIGS. 5 and 6, the guide member 100 is mounted with a torsion coil spring 100T. The torsion coil spring 100T is configured to urge the guide member 100 to swing around the swinging shaft center X100 in a clockwise direction towards the drawing sheets of FIGS. 4 and 8, i.e., to urge the guide member 100 to come close to the stacking surface 92A.

As shown in FIGS. 4 and 8, a lower surface of the chute member 93 having the second sheet support surface 93A formed on the upper surface thereof is provided with a stopper 109. The stopper 109 protrudes downwardly at a position spaced upwardly from the guide member 100. When the guide member 100 swings in a counterclockwise direction towards the drawing sheets of FIGS. 4 and 8 against the urging force of the torsion coil spring 100T, the stopper 109 abuts on the guide member 100 to restrain a swinging range of the guide member 100.

As shown in FIG. 7, the guide member 100 is formed with a first guide surface 110, second guide surfaces 120, inclined surfaces 130 and restraint surfaces 140.

The first guide surface 110 is formed on a downwardly facing surface (a surface facing the stacking surface 92A) of the bulging part 101. The first guide surface 110 has a base line M110 shown with a dashed-two dotted line in FIG. 7. The base line M110 extends in parallel with the front-rear direction, which is the width direction of the stacking surface 92A. The first guide surface 110 is a downwardly inclined surface, which is defined as the base line M110 is moved rightward from the swinging shaft center X100-side, i.e., towards the downstream side of the discharge direction D1.

As shown in FIG. 8, the first guide surface 110 is inclined towards the stacking surface 92A as it proceeds downstream in the discharge direction D1. An inclined angle of the first guide surface 110 relative to the stacking surface 92A is defined as a first inclined angle $\alpha$1.

As shown in FIGS. 7 and 8, the first guide surface 110 includes a curved surface 119. The curved surface 119 is slightly curved upwardly from a position below the swinging shaft center X100, i.e., towards a direction getting away from the stacking surface 92A and connects to the part of the first guide surface 110 inclined at the first inclined angle $\alpha$1.

As shown in FIG. 7, the second guide surfaces 120 and the restraint surfaces 140 are positioned at the front and the rear than the first guide surface 110. The inclined surfaces 130 are positioned between the first guide surfaces 110 and the restraint surfaces 140. As shown in FIG. 5, in the front guide member 100, when the sheet SH is discharged, the second guide surface 120, the inclined surface 130 and the restraint surface 140 positioned at the rear of the first guide surface 110 function, and the second guide surface 120, the inclined surface 130 and the restraint surface 140 positioned at the front of the first guide surface 110 do not function. Also, in the rear guide member 100, when the sheet SH is discharged, the second guide surface 120, the inclined surface 130 and the restraint surface 140 positioned at the front of the first guide surface 110 function, and the second guide surface 120, the inclined surface 130 and the restraint surface 140 positioned at the rear of the first guide surface 110 do not function. This is a configuration for commonalizing the components of the guide member 100.

That is, the second guide surfaces 120, the inclined surfaces 130 and the restraint surfaces 140 of the pair of front-and-rear guide members 100,100, which function when the sheet SH is discharged, are positioned close to the protrusion 170 in the front-rear direction, i.e., at inner parts of the first guide surfaces 110 in the width direction of the stacking surface 92A.

As shown in FIGS. 7 and 9 to 10A, the second guide surfaces 120 are downwardly facing flat surfaces of flat plate parts positioned at the front and the rear of the bulging part 101 of the guide member 100. The second guide surfaces 120 are positioned above the first guide surface 110.

As shown in FIG. 8, the second guide surface 120 extends rightward from the swinging shaft center X100-side, i.e., towards the downstream side in the discharge direction D1. The second guide surface 120 is inclined towards the stacking surface 92A as it proceeds downstream in the discharge direction D1. An inclined angle of the second guide surface 120 relative to the stacking surface 92A is defined as a second inclined angle $\alpha$2. The second inclined angle $\alpha$2 is set to be smaller than the first inclined angle $\alpha$1.

As shown in FIG. 7, the front inclined surface 130 is formed between the first guide surface 110 and the front second guide surface 120. The front inclined surface 130 is inclined upwardly from a front-right angled part of the first guide surface 110 to come close to the front second guide surface 120. The rear inclined surface 130 is formed between the first guide surface 110 and the rear-second guide surface 120. The rear inclined surface 130 is inclined upwardly from a rear-right angled part of the first guide surface 110 to come close to the rear-second guide surface 120.

That is, the inclined surfaces 130 of the pair of front-and-rear guide members 100, 100, which function when the sheet SH is discharged, connect to the first guide surfaces 110 at the sides distant from the protrusion 170 in the front-rear direction, i.e., at the outer sides with respect to the center of the stacking surface 92A in the width direction, and are inclined towards the second guide surfaces 120 as each of the inclined surfaces proceed towards close to the protrusion 170 in the front-rear direction, i.e., towards the inner parts of the stacking surface 92A in the width direction.

As shown in FIG. 7, the front restraint surface 140 connects to a rear end edge of the front second guide surface 120 from rear. The front restraint surface 140 extends downwardly in the direction D2 orthogonal to the stacking surface 92A to come close to the stacking surface 92A. A lower end edge of the front restraint surface 140 connects to a front end edge of the front inclined surface 130. The rear restraint surface 140 connects to a front end edge of the rear-second guide surface 120 from a front side. The rear restraint surface 140 extends downwardly in the direction D2 orthogonal to the stacking surface 92A to come close to the stacking surface 92A. A lower end edge of the rear restraint surface 140 connects to a rear end edge of the rear inclined surface 130.

That is, the restraint surfaces 140 of the pair of front-and-rear guide members 100, which function when the sheet SH is discharged, connect to the second guide surfaces 120 at the sides distant from the protrusion 170 in the front-rear direction, i.e., at the outer sides with respect to the center of the stacking surface 92A in the width direction, and extend in the direction D2 orthogonal to the stacking surface 92A to come close to the stacking surface 92A.

Figures 9A, 9B:
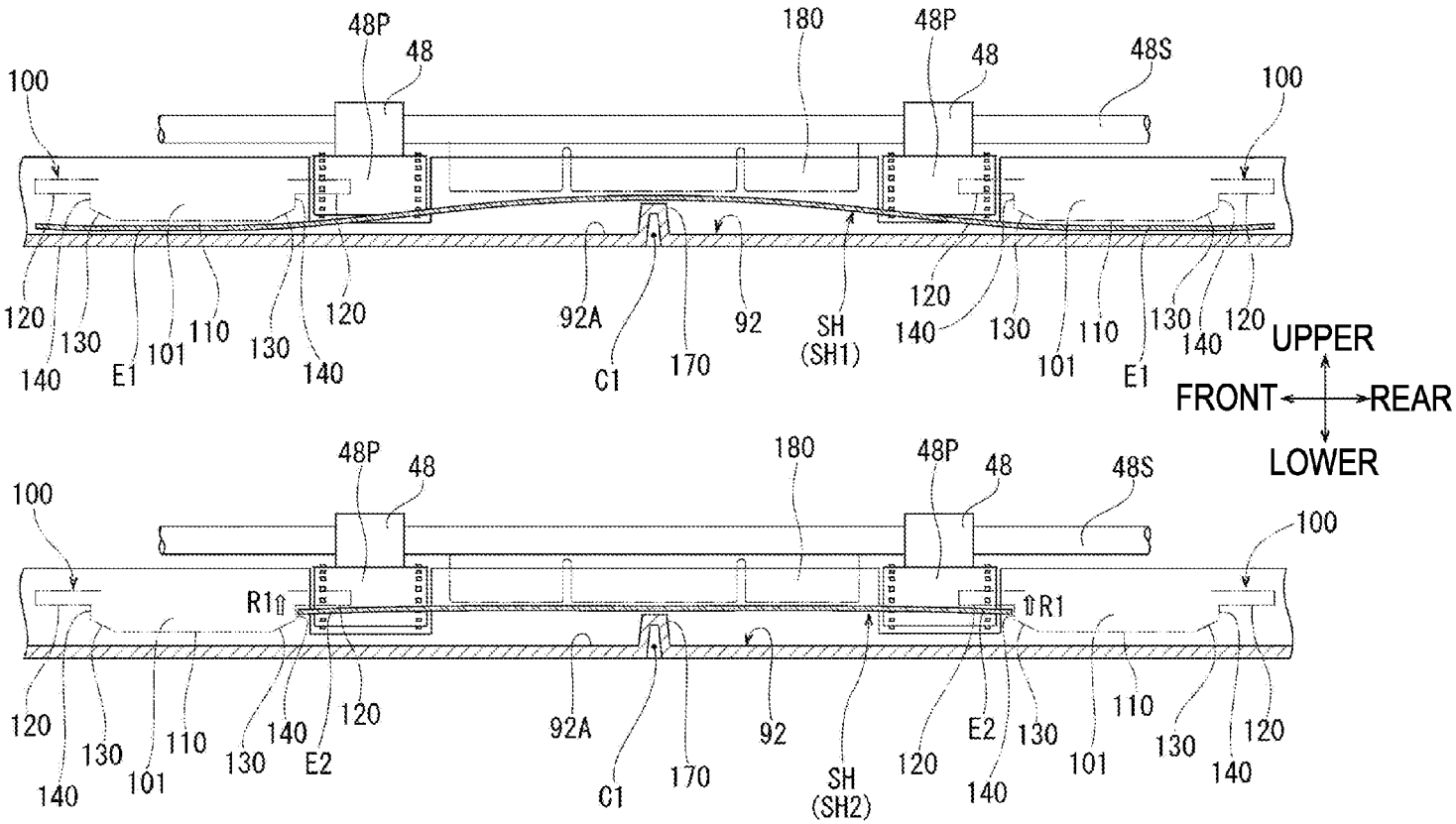
FIG. 9A is a schematic view illustrating a state where a first size sheet is guided by a first guide surface and FIG. 9B is a schematic view illustrating a state where a second size sheet is guided by a second guide surface.
Figures 10A, 10B:
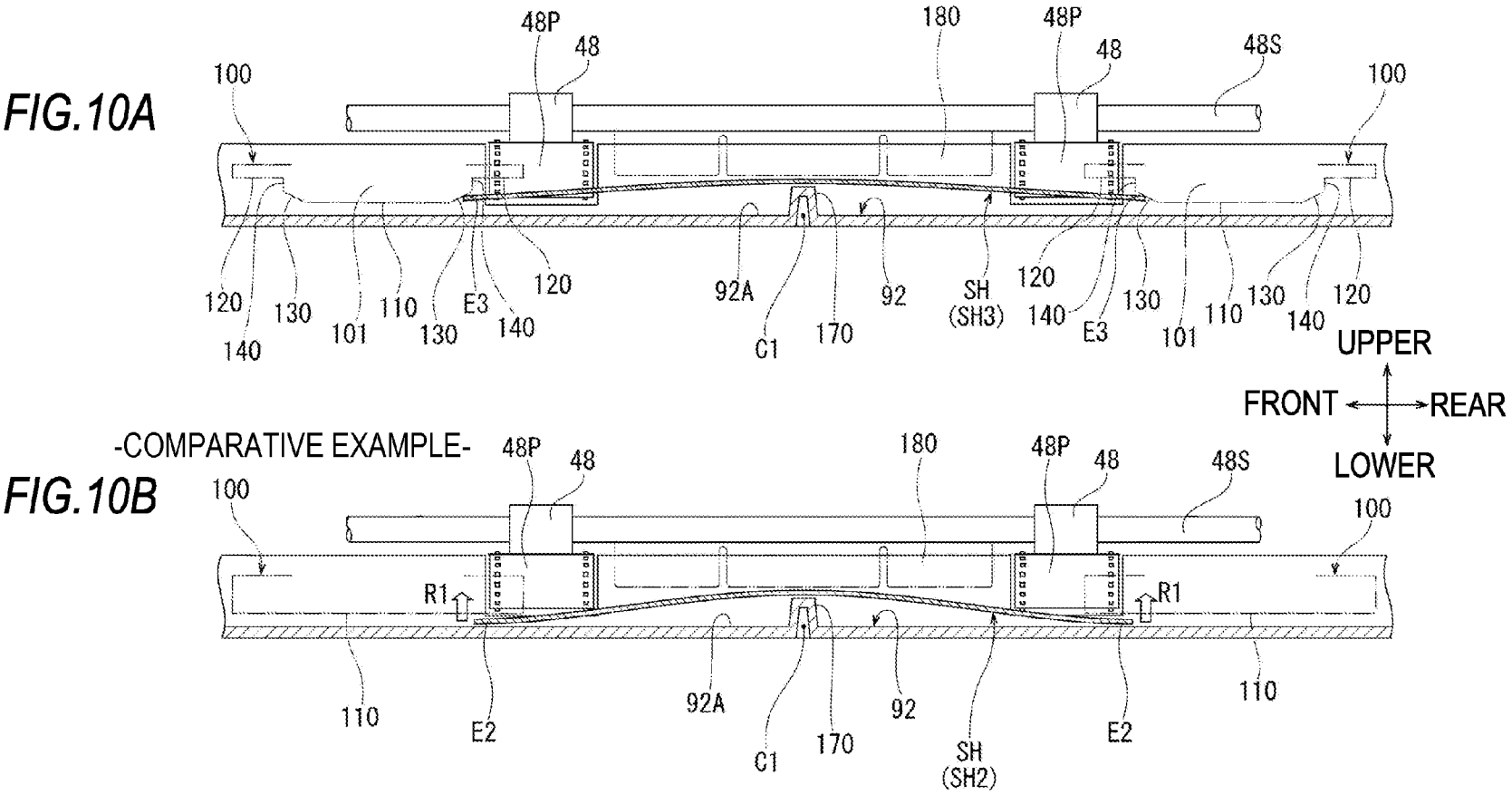
FIG. 10A is a schematic view illustrating a state where a sheet having a size between the first size sheet and the second size sheet is guided by an inclined surface.
FIG. 10B is a schematic view illustrating a comparative example where the first guide is configured to guide the second size sheet, too.

As shown in FIGS. 9 to 10A, the restraint surface 140 extends perpendicularly to the stacking surface 92A, as seen from a cross-section orthogonal to the discharge direction D1. As shown in FIG. 5, the restraint surface 140 extends in parallel with the discharge direction D1, in the top view. An interval between the front restraint surface 140 and the rear restraint surface 140 in the front-rear direction is slightly greater than the length W2 of the second size sheet SH2 in the front-rear direction.

As shown in FIGS. 5 and 9A, the first guide surface 110 is positioned at the outer side with respect to the center of the restraint surface 140, which functions when the sheet SH is discharged, in the width direction. Therefore, the first guide surface 110 may contact a first end portion E1 of the first size sheet SH1, which is an end portion in the width direction, from above, i.e., from an opposite side to the stacking surface 92A.

As shown in FIGS. 5 and 9B, the second guide surface 120, which functions when the sheet SH is discharged, is positioned at the center side with respect to the center of the restraint surface 140, which functions when the sheet SH is discharged, in the width direction. Therefore, the second guide surface 120, which functions when the sheet SH is discharged, may contact a second end portion E2 of the second size sheet SH2, which is an end portion in the width direction, from above, i.e., from an opposite side to the stacking surface 92A.

As shown in FIGS. 4 to 6 and 9 to 10A, the pressing member 180 is a film-shaped member obtained by cutting a thin sheet made of PET resin, for example, into a substantially rectangular shape. The pressing member 180 is provided between the pair of guide members 100, 100 in the front-rear direction. Although not shown, a left end portion of the pressing member 180 is attached to a right end portion of the upper guide wall 46. The pressing member 180 is inclined rightward and downward to come close to the stacking surface 92A. As shown in FIGS. 9 to 10A, the pressing member 180 may contact the sheet SH, which is discharged to the discharge tray 92, from above, i.e., from an opposite side to the stacking surface 92A.

<Operational Effects>

In the below description, the second guide surface 120, the inclined surface 130 and the restraint surface 140, which do not function, are omitted.

As shown in FIGS. 9 and 10A, according to the image reading apparatus 1 of the first illustrative embodiment, when the sheet SH is discharged by the discharge rollers 48, the pressing member 180 presses the sheet SH towards the stacking surface 92A. Thereby, the sheet SH is suitably guided towards the stacking surface 92A.

When the sheet SH is supported on the stacking surface 92A, the protrusion 170 lifts the sheet SH on the central line C1 of the stacking surface 92A. Thereby, the sheet SH is bent into a reverse U shape, as seen from a section orthogonal to the discharge direction D1, so that both ends of the sheet SH are prevented from being a curl shape as if they floated from the stacking surface 92A. That is, it is possible to provide resilience for the sheet SH on the second sheet support surface 93A by the protrusion 170. Thereby, it is possible to suppress the sheet SH, which will be discharged onto the stacking surface 92A next time, from being caught at the sheet SH already discharged on the stacking surface 92A.

As shown in FIG. 9A, according to the image reading apparatus 1, when the first size sheet SH1 is discharged by the discharge rollers 48, the first guide surfaces 110 contact the first end portions E1 of the sheet SH1, which are the end portions in the width direction, from the opposite side to the stacking surface 92A and guide the sheet SH1 towards the stacking surface 92A. A trajectory along which the first end portions of the sheet SH1 are guided by the first guide surfaces 110 is indicated by the dashed-two dotted line K1 in FIG. 8.

Here, as shown in FIG. 8, the second inclined angle $\alpha 2$ of the second guide surface 120 positioned at the center side with respect to the center of the first guide surface 110 in the width direction is set to be smaller than the first inclined angle $\alpha 1$ of the first guide surface 110. Thereby, it is possible to suppress the second guide surface 120 from contacting the first size sheet SH1 and interfering with the operation of the first guide surface 110.

As shown in FIG. 9B, when the second size sheet SH2 smaller than the first size sheet SH1 is discharged by the discharge rollers 48, the second guide surfaces 120 contact the second end portions E2 of the sheet SH2, which are the end portions in the width direction, from the opposite side to the stacking surface 92A and guide the sheet SH2 towards the stacking surface 92A. At this time, the restraint surfaces 140 sandwich the second size sheet SH2, which is discharged onto the discharge tray 92, in the front-rear direction, thereby restraining a positional deviation of the sheet SH2 relative to the stacking surface 92A in the front-rear direction. A trajectory along which the second end portions E2 of the sheet SH2 are guided by the second guide surfaces 120 is indicated by a dashed-two dotted line K2 in FIG. 8. The trajectory K2 of the second end portions E2 of the second size sheet SH2 is higher than the trajectory K1 of the first end portions E1 of the first size sheet SH1 and is more gently inclined rightward and downward than the trajectory K1.

As shown in FIG. 10A, when a sheet SH3 having a size between the first size sheet SH1 and the second size sheet SH2 is discharged by the discharge rollers 48, the inclined surfaces 130 contact end portions E3 of the intermediate size sheet SH3, which are end portions in the width direction, from the opposite side to the stacking surface 92A and guide the sheet SH3 towards the stacking surface 92A. A trajectory along which the end portions E3 of the intermediate size sheet SH3 are guided is indicated by a dashed-two dotted line K3 in FIG. 3. The trajectory K3 of the end portions E3 of the intermediate size sheet SH3 is higher than the trajectory K1 of the first end portions E1 of the first size sheet SH1 and lower than the trajectory K2 of the second end portions E2 of the second size sheet SH2 and is more gently inclined rightward and downward than the trajectory K1.

The second size sheet SH2 has a larger ratio of a thickness to a length in the width direction than the first size sheet SH1, so that the resilience thereof tends to be stronger. Here, as shown in FIG. 10B, which is a comparative example, a case is assumed in which the first guide surface 110 is formed from a front end to a rear end of the guide member 100, the first guide surface 110 contacts the second end portion E2 of the second size sheet SH2, which is an end portion in the width direction, from the opposite side to the stacking surface 92A and guides the sheet SH2 towards the stacking surface 92A. In this case, according to the comparative example shown in FIG. 10B, the second size sheet SH2 is largely bent, as can be seen from the comparison with FIG. 9B. Therefore, a reactive force R1, which is applied when the second size sheet SH2 is bent, is increased, so that the second size sheet SH2 is easy to deviate in the front-rear direction.

In this regard, according to the image reading apparatus 1, as shown in FIG. 9B, the first guide surface 110 positioned at the outer side of the second guide surface 120 in the width direction does not contact the second end portion E2 of the second size sheet SH2. Also, when the second guide surface 120 guides the second end portion E2 of the second size sheet SH2, the second size sheet SH2 that is guided at the second inclined angle $\alpha 2$ smaller than the first inclined angle $\alpha 1$ is less bent. Therefore, the reactive force R1, which is applied when the second size sheet SH2 is bent, is reduced, as compared to the comparative example shown in FIG. 10B, so that it is possible to suppress the second size sheet SH2 from deviating in the front-rear direction.

Likewise, as shown in FIG. 10A, when the inclined surfaces 130 guide the end portions E3 of the intermediate size sheet SH3, the reactive force, which is applied when the sheet SH3 is bent, is also reduced. Therefore, it is also possible to suppress the intermediate size sheet SH3 from deviating in the front-rear direction.

Further, according to the image reading apparatus 1, the guide member 100 is one member. Therefore, it is possible to suppress an increase in the number of components, thereby simplifying a mounting operation.

Therefore, according to the image reading apparatus 1 of the first illustrative embodiment, while it is possible to save the manufacturing cost, it is possible to orderly stack a plurality of types of the sheets SH including the first size sheet SH1, the second size sheet SH2 and the intermediate size sheet SH3 on the stacking surface 92A when discharging the sheets SH onto the stacking surface 92A.

Specifically, according to the image reading apparatus 1, since the positional deviation of the second size sheet SH2 in the front-rear direction is restrained by the restraint surfaces 140, it is possible to stack the second size sheet SH2 on the stacking surface 92A more orderly. Also, the sheet SH to be discharged is guided with high precision on the stacking surface 92A by the first guide surfaces 110 and the second guide surfaces 120 formed on the pair of guide members 100, so that it is also possible to suppress the sheet SH from deviating in the front-rear direction as regards the protrusion 170. Therefore, it is possible to orderly stack the sheets SH with being bent on the stacking surface 92A.

Further, as shown in FIGS. 7 and 8, according to the image reading apparatus 1, the first guide surface 110 includes the curved surface 119. Therefore, it is possible to suppress a tip of the sheet SH to be discharged to the discharge tray 92 from being caught at the first guide surface 110. Therefore, according to the image reading apparatus 1, it is possible to guide the sheet SH towards the stacking surface 92A more suitably by the first guide surface 110.

Also, according to the image reading apparatus 1, even when the guide member 100 is pushed to return by the sheet SH being discharged, as shown with the dashed-two dotted line in FIG. 8, the guide member 100 collides with the stopper 109 to stop. Therefore, according to the image reading apparatus 1, it is possible to prevent a situation where the guide member 100 excessively swings and thus has difficulty in guiding the sheet SH being discharged towards the stacking surface 92A.

Second Illustrative Embodiment

Figure 11:
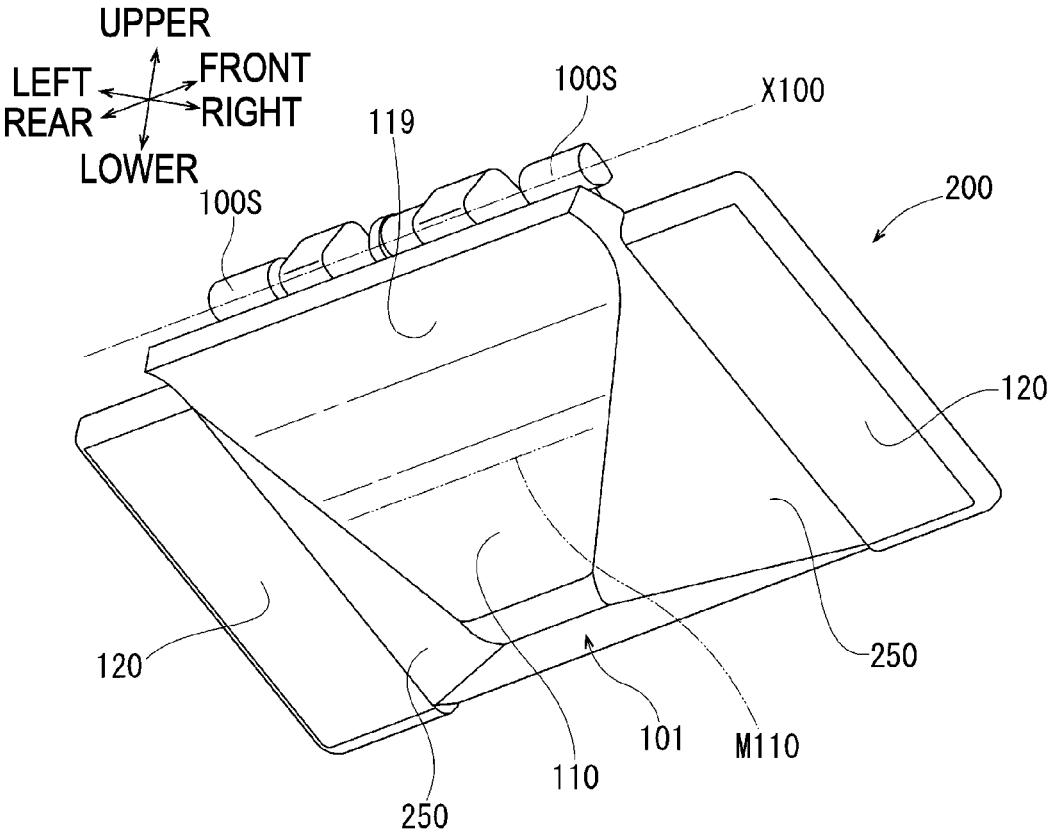
FIG. 11 is a perspective view of a guide member of an image reading apparatus of a second illustrative embodiment.

As shown in FIG. 11, according to an image reading apparatus of a second illustrative embodiment, a guide member 200 is used, instead of the guide member 100 of the image reading apparatus of the first illustrative embodiment. The other configurations of the second illustrative embodiment are the same as the first illustrative embodiment. Therefore, the same configurations as the first illustrative embodiment are denoted with the same reference numerals and the descriptions thereof are omitted or simplified.

In the image reading apparatus of the second illustrative embodiment, the guide member 200 is formed with connection surfaces 250, instead of the inclined surfaces 130 and restraint surfaces 140 of the guide member 100 of the first illustrative embodiment. The other configurations of the guide member 200 are the same as the guide member 100.

The front connection surface 250 is formed between the first guide surface 110 and the front second guide surface 120. The front connection surface 250 is inclined upwardly from a front-right angled part of the first guide surface 110 to come close to the front second guide surface 120. A front end edge of the front connection surface 250 connects to the rear end edge of the front second guide surface 120. The rear connection surface 250 is formed between the first guide surface 110 and the rear-second guide surface 120. The rear connection surface 250 is inclined upwardly from a rear-right angled part of the first guide surface 110 to come close to the rear-second guide surface 120. A rear end edge of the rear connection surface 250 connects to the front end edge of the front second guide surface 120.

That is, the connection surfaces 250 of the pair of front-and-rear guide members 200, 200, which function when the sheet SH is discharged, connect to the first guide surfaces 110 at the sides distant from the protrusion 170 in the front-rear direction, i.e., at the outer sides with respect to the center of the stacking surface 92A in the width direction, and are inclined to connect to the second guide surfaces 120 at the sides close to the protrusion 170 in the front-rear direction, i.e., at the center sides with respect to the center of the stacking surface 92A in the width direction.

According to the image reading apparatus of the second illustrative embodiment, like the image reading apparatus of the first illustrative embodiment, while it is possible to save the manufacturing cost, it is possible to orderly stack the first size sheet SH1 and the second size sheet SH2 on the stacking surface 92A by the first guide surfaces 110 and the second guide surfaces 120 when discharging the sheets SH1, SH2 onto the stacking surface 92A.

Also, according to this image reading apparatus, it is possible to suitably guide the sheet SH having a size between the sheet SH having a size, which may be guided by the first guide surface 110, and the sheet SH having a size, which may be guided by the second guide surface 120, towards the stacking surface 92A by the connection surfaces 250. Therefore, according to the image reading apparatus, it is possible to orderly stack the intermediate size sheet SH on the stacking surface 92A.

Although this disclosure has been described with reference to the first and second illustrative embodiments, this disclosure is not limited to the first and second illustrative embodiments and can be appropriately changed without departing from the gist thereof.

For example, this disclosure can be applied to an image reading apparatus, an image forming apparatus, a complex machine and the like.

What is claimed is:

1. A sheet conveying device comprising:

a conveyor configured to:

convey a sheet along a predetermined conveyance path; and discharge the sheet in a discharge direction by a discharge roller;

a stacking surface configured to support the sheet discharged by the discharge roller; and a movable member provided downstream from the discharge roller in the discharge direction and supported so as to be swingable on a swinging shaft extending parallel with a width direction of the stacking surface, wherein the movable member has a first surface and a second surface that is positioned closer to a center of the stacking surface in the width direction than the first surface, wherein the first surface is inclined at a first inclined angle relative to the stacking surface so that the first surface is inclined towards the stacking surface in the discharge direction, wherein the second guide surface is inclined at a second inclined angle relative to the stacking surface so that the second surface is inclined towards the stacking surface in the discharge direction, and wherein the second inclined angle is smaller than the first inclined angle.

2. The sheet conveying device according to claim 1, wherein the movable member is configured to guide the sheet to be discharged towards the stacking surface.

3. The sheet conveying device according to claim 1, wherein the first surface has a base line extending parallel with the width direction.

4. The sheet conveying device according to claim 1, wherein the first surface is configured to:

contact a first edge portion of a first size sheet in the width direction from an opposite side to the stacking surface with respect to the first size sheet; and guide the first size sheet towards the stacking surface, wherein the first size sheet has a maximum size that is allowed to be conveyed by the conveyor, wherein the second surface is configured to:

contact a second edge portion of a second size sheet in the width direction from an opposite side to the stacking surface with respect to the second size sheet; and guide the second size sheet towards the stacking surface, and wherein the second size sheet is smaller than the first size sheet.

5. The sheet conveying device according to claim 1, wherein the movable member further has an inclined surface between the first surface and the second surface, and wherein the inclined surface is positioned closer to the center of the stacking surface in the width direction than the first surface and in contact with the first surface while being inclined towards the second surface in the width direction.

6. The sheet conveying device according to claim 1, wherein the movable member further has a restraint surface that is positioned farther from the center of the stacking surface in the width direction than the second surface and in contact with the second surface, wherein the restraint surface extends towards the stacking surface in a direction orthogonal to the stacking surface.

7. The sheet conveying device according to claim 1, wherein the movable member further has a connection surface having one end and the other end in the width direction, and wherein the one end of the connection surface in the width direction is in contact with the first surface and the other end of the connection surface in the width direction is in contact with the second surface while the connection surface is inclined between the first surface and the second surface.

8. The sheet conveying device according to claim 1, further comprising:

a pair of guide members, one of the pair of guide members provided at one side with respect to the center of the stacking surface in the width direction and the other of the pair of guide members provided at the other side with respect to the center of the stacking surface in the width direction; and a protrusion provided at a middle portion of the stacking surface in the width direction, the protrusion protruding in a direction orthogonal to the stacking surface and extending in the discharge direction.

9. The sheet conveying device according to claim 1, wherein the first surface further has a curved surface curved in a direction away from the stacking surface.

10. The sheet conveying device according to claim 1, further comprising a stopper configured to restrain a swinging range of the movable member.

11. The sheet conveying device according to claim 1, further comprising:

a pair of movable members, one of the pair of movable member provided at one side with respect to the center of the stacking surface in the width direction and the other of the pair of movable member provided at the other side with respect to the center of the stacking surface in the width direction, and a pressing member provided between the movable members in the width direction.

12. The sheet conveying device according to claim 11, wherein the pressing member is configured to:

contact the sheet to be discharged from an opposite side to the stacking surface with respect to the sheet; and press the sheet to be discharged towards the stacking surface.

13. The sheet conveying device according to claim 1, further comprising a reading unit provided upstream from the discharge roller in the discharge direction and configured to read an image of the sheet conveyed by the conveyor.

* * * * *